US008740637B2

(12) United States Patent
Wang et al.

(10) Patent No.: US 8,740,637 B2
(45) Date of Patent: Jun. 3, 2014

(54) PLUG CONNECTOR HAVING A RELEASING MECHANISM WITH CONVENIENT AND STEADY OPERATION

(75) Inventors: Chien-Chiung Wang, New Taipei (TW); Qing-Man Zhu, Kunshan (CN); Peng Zhai, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 54 days.

(21) Appl. No.: 13/464,073

(22) Filed: May 4, 2012

(65) Prior Publication Data

US 2012/0282790 A1 Nov. 8, 2012

(30) Foreign Application Priority Data

May 6, 2011 (CN) ..... 2011 0 116673

(51) Int. Cl.
*H01R 13/62* (2006.01)

(52) U.S. Cl.
USPC ..... 439/352

(58) Field of Classification Search
USPC ..... 439/352
See application file for complete search history.

(56) References Cited

U.S. PATENT DOCUMENTS

| | | | | |
|---|---|---|---|---|
| 6,371,787 | B1 * | 4/2002 | Branch et al. | 439/352 |
| 7,281,937 | B2 | 10/2007 | Reed et al. | |
| 7,540,755 | B1 * | 6/2009 | Wu | 439/352 |
| 7,666,023 | B2 * | 2/2010 | Wu | 439/352 |
| 7,828,579 | B2 * | 11/2010 | Huang | 439/352 |
| 7,841,887 | B2 * | 11/2010 | Zhang et al. | 439/352 |
| 7,938,669 | B2 * | 5/2011 | Li et al. | 439/352 |
| 8,251,733 | B2 * | 8/2012 | Wu | 439/352 |
| 2007/0161281 | A1 * | 7/2007 | Wu | 439/352 |
| 2008/0032541 | A1 * | 2/2008 | Reed et al. | 439/352 |
| 2010/0210131 | A1 * | 8/2010 | Reed et al. | 439/352 |

* cited by examiner

*Primary Examiner* — Gary Paumen
(74) *Attorney, Agent, or Firm* — Ming Chieh Chang; Wei Te Chung

(57) ABSTRACT

A plug connector comprises: a housing and a releasing mechanism mounted on the housing and comprising a pulling portion and a latching member, the latching member defining a latching portion for latching a complementary connector, the pulling portion having a groove and the latching member having an ear portion engaged with the groove, the ear portion being able to rise out of the groove in response to a rearward movement of the pulling portion to move the latching portion from a latched position to a released position.

12 Claims, 6 Drawing Sheets

PLUG CONNECTOR HAVING A RELEASING MECHANISM WITH CONVENIENT AND STEADY OPERATION

FIELD OF THE INVENTION

The present invention relates to a plug connector, and more particularly to a plug connector having a releasing mechanism.

Description of Prior Art

U.S. Pat. No. 7,281,937 issued on Oct. 16, 2007 discloses a plug connector defining a body portion having a ramp surface, and a latching member mounted on the body portion. The latching member includes an actuator and a latching arm. The latching arm comprises an inclined segment extending obliquely and having an engagement hook for latching to a complementary connector. A front end of the actuator has a lobe. The actuator is located between the body portion and the latching arm when the latching member is mounted on the body portion. The lobe of the actuator is located between the ramp surface of the body portion and the inclined segment of the latching arm. When the actuator is pulled rearwardly, the lobe is slid upwardly along the ramp surface, and the engagement hook is risen and arrived at a released position from a latched position. The lobe, the ramp surface, the inclined segment, and the engagement hook are required to cooperate with one another for properly releasing the locking status of the plug connector.

An improved releasing mechanism is desired.

SUMMARY OF THE INVENTION

Accordingly, an object of the present invention is to provide a plug connector with simple latching member that can be operated steadily.

In order to achieve the above-mentioned objects, a plug connector comprises: a housing and a releasing mechanism mounted on the housing and comprising a pulling portion and a latching member, the latching member defining a latching portion for latching a complementary connector, the pulling portion having a groove and the latching member having an ear portion engaged with the groove, the ear portion being able to rise out of the groove in response to a rearward movement of the pulling portion to move the latching portion from a latched position to a released position.

Other objects, features and advantages of the invention will be apparent from the following detailed description taken in connection with the accompanying drawings.

DETAILED DESCRIPTION OF PREFERRED EMBODIMENTS

Figure 1:
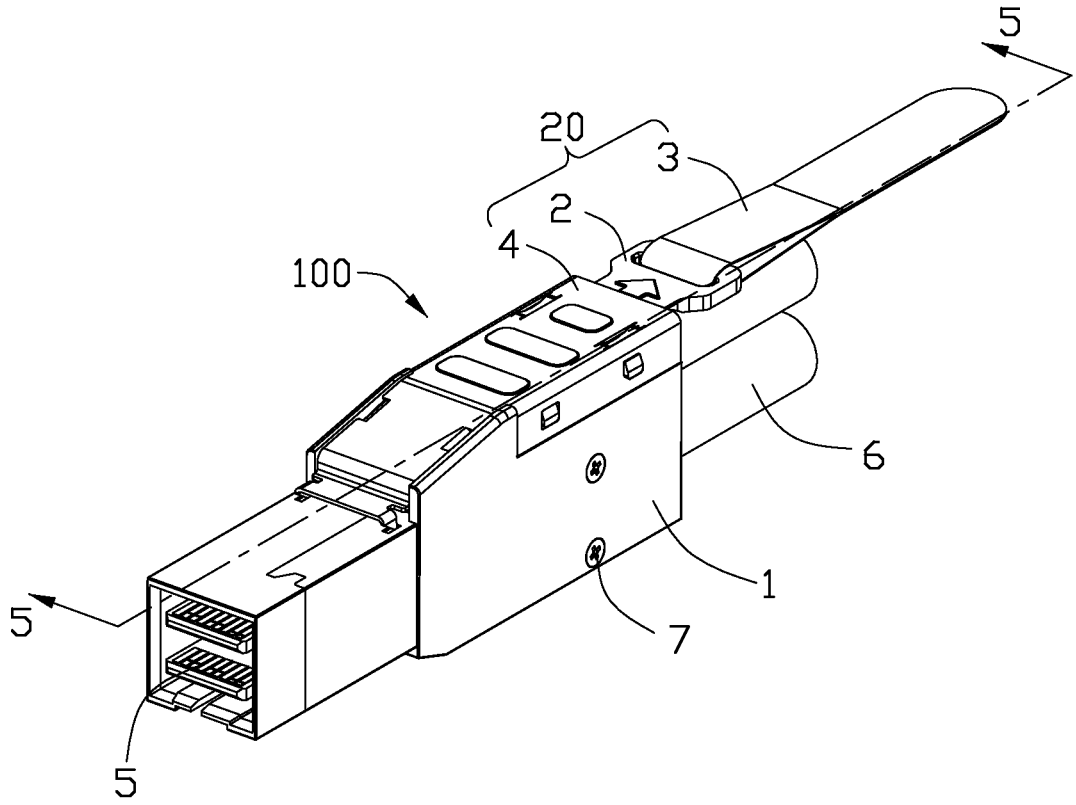
FIG. 1 is a perspective view of a plug connector in accordance with the present invention.
Figure 2:
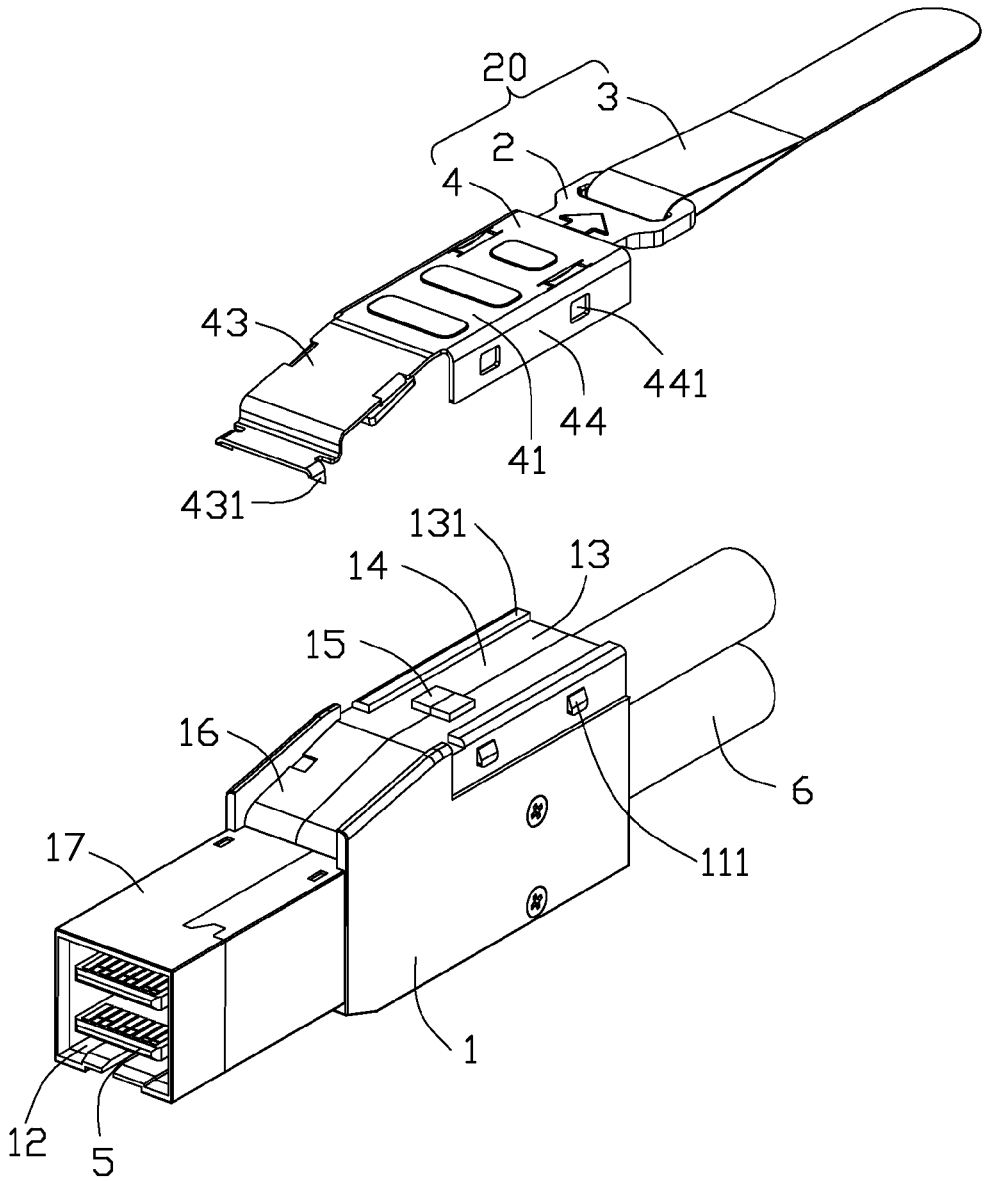
FIG. 2 is a partly assembled, perspective view of the plug connector shown in FIG. 1.
Figure 3:
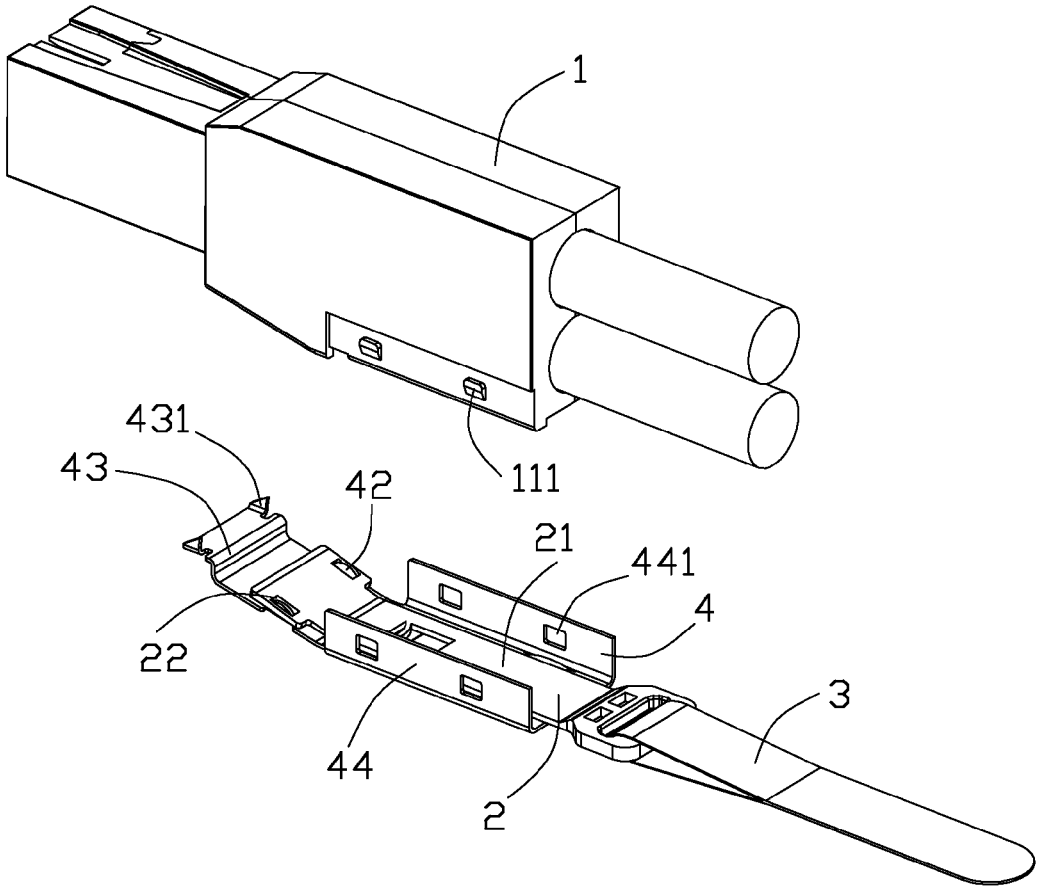
FIG. 3 is a view similar to FIG. 1, but from another aspect.
Figure 4:
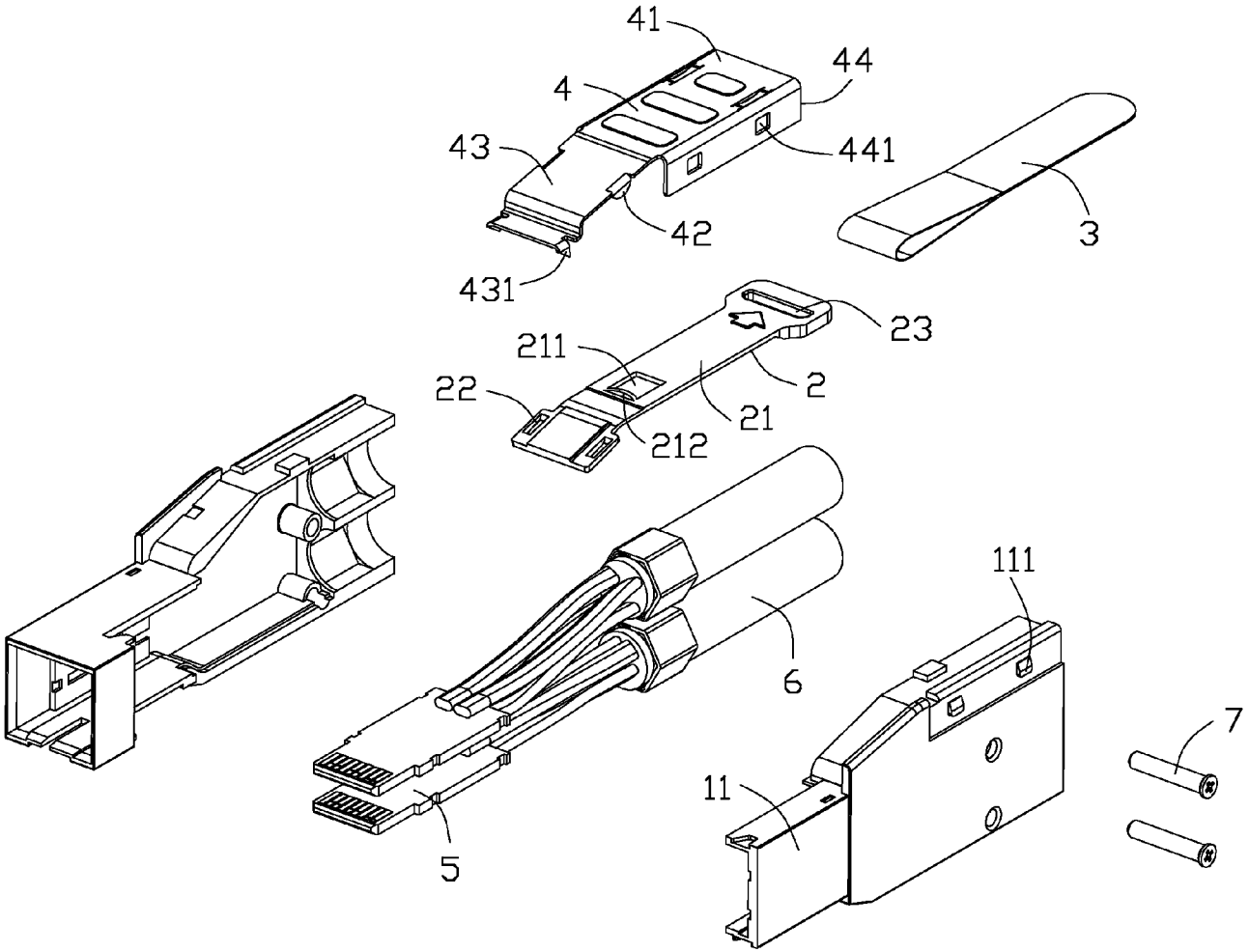
FIG. 4 is an exploded, perspective view of the plug connector shown in FIG. 1.
Figure 5:
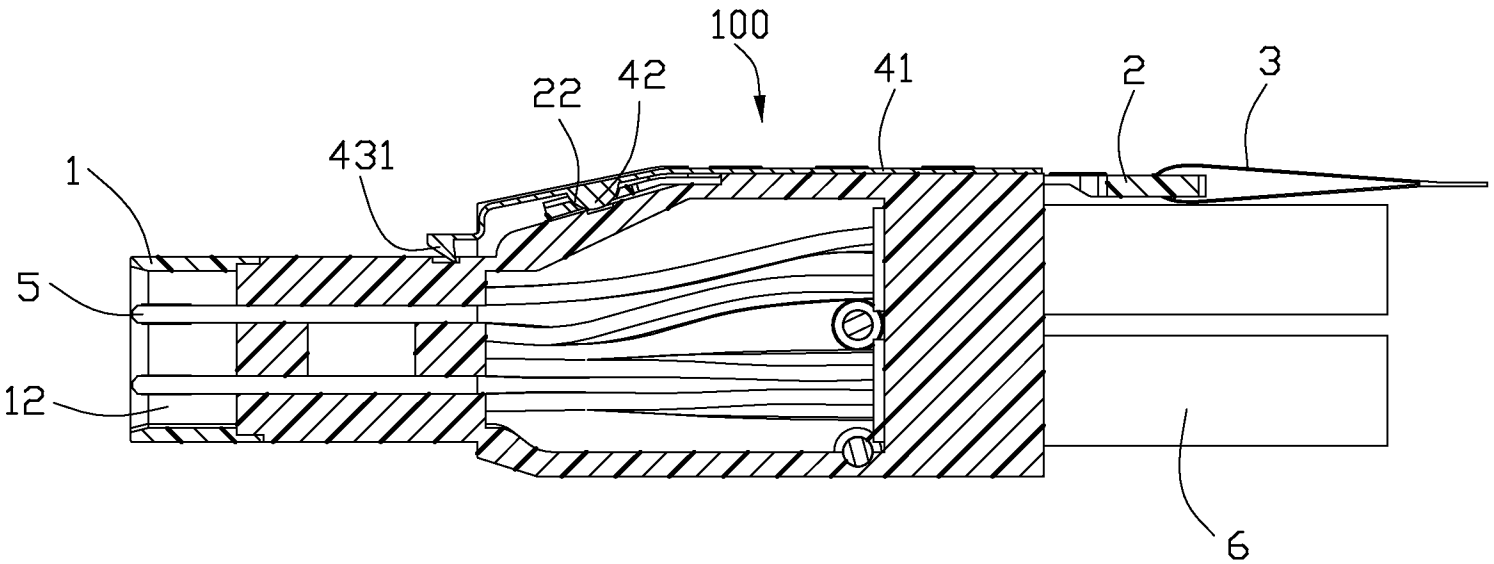
FIG. 5 is a cross-sectional view of the plug connector assembly in a latched position, taken along line 5-5 of FIG. 1.

Reference will now be made to the drawing figures to describe the present invention in detail.

Referring to FIGS. 1 to 5, a plug connector 100 mating to a complementary connector (not shown) in accordance with the present invention comprises a housing 1, a releasing mechanism 20 mounted on the housing 1, a circuit board 5 received in the housing 1 and a cable 6 connected to the circuit board 5. As needed, one or a pair of the circuit board(s) 5 is/are disposed in the housing 1. The number of the cable 6 corresponds to the circuit board's 5. The releasing mechanism 20 comprises a pulling portion operated by a user and a latching member 4 for latching the complementary connector. In this embodiment, the pulling portion comprises an actuator 2 and a pulling tape 3 engaged with the actuator 2. In other embodiments, the actuator 2 and the pulling tape 3 can be an integrated structure.

The housing 1 is formed by two semi-housings 11 fastening each other along a left-to-right direction of the plug connector 100, and two semi-housings 11 are fixed through at least two screws 7. Each semi-housing 11 defines a pair of snapping portions 111 extending outwardly from an outer surface thereof, respectively. The housing 1 has a receiving cavity 12, a supporting portion 13 located on the rear thereof, and an inserting portion 17 lower than supporting portion 13 and located on the front thereof, and a ramp 16 extending inclining and located between the inserting portion 17 and the supporting portion 13. A pair of ribs 131 are located on two lateral sides of the supporting portion 13, respectively. A channel 14 is located between the ribs 131. A protruding portion 15 is defined in the channel 14. In this embodiment, two semi-housings 11 are fastened along a left-to-right direction of the plug connector 100. In other embodiments, the housing 1 can be an integrated structure or be fastened each other by two other structural semi-housings 11 along other directions.

The actuator 2 comprises a main body 21 extending horizontally, a connecting slot 23 located on the rear of the main body 21. The main body 21 defines a sliding slot 211, in which the protruding portion 15 of the housing 1 is slid. The protruding portion 15 can not offset along the left-to-right direction of the plug connector 100 when the protruding portion 15 is sliding in the sliding slot 211 along a front-to-rear direction of the plug connector 100. Simultaneously, the protruding portion 15 blocks off the actuator 2 to make the actuator 2 not get away rearwardly from the housing 1. An elastic portion 212 is arched from the front end to the rear end thereof, and located in the sliding slot 211. The elastic portion 212 can provide the protruding portion 15 of the housing 1 with resilience. The main body 21 defines a pair of grooves 22 located at two lateral sides of the front end thereof, respectively. In this embodiment, the groove 22 is a slot shape. In other embodiments, the groove 22 can be a hollow region. Only the front end of the groove 22 has a step sharp with effect to rise the latching member 4, the feature can meet the needs of the present invention.

The latching member 4 comprises a flat covering portion 41, an extending portion 43 extending forwardly from the covering portion 41 and a pair of retaining portion 44 extending downwardly from two lateral sides of the covering portion 41. A pair of ear portions 42 are located respectively at two lateral sides of the extending portion 43 and extending downwardly from the extending portion 43. A lower surface of the ear portion 42 has semi-circular arc or other shapes which is conveniently to slide. A pair of latching portions 431 are located on the front end of the extending portion 43. The retaining portion 44 defines a pair of retaining holes 441 for receiving and coordinating to the snapping portions 111, respectively. The retaining holes 441 can be defined on the housing 1 to let the snapping portions 111 be defined on the retaining portion 44.

Referring to FIGS. 1 to 4, in assembly, a pair of semi-housings 11 are fastened each other along the left-to-right direction and the screws 7 fixed on the housing 1. The circuit board 5 connecting to the cable 6 is received in the receiving cavity 12 of the housing 1. The actuator 2 is located in the channel 14, and the protruding portion 15 of the housing 1 prevents the actuator 2 from slide deucedly in the sliding slot 211 of the actuator 2. The elastic portion 212 in the sliding slot 211 provides the protruding portion 15 with resilience. The pulling tape 3 is fastening in the connecting slot 23 of the actuator 2. The latching member 4 is fastened on the housing 1, and the covering portion 41 of the latching member 4 is supported by the ribs 131, and the ear 42 portions is inserted into the grooves 22, respectively, and the latching portion 431 of the latching member 4 is located over the inserting portion 17 for latching the complementary connector.

Figure 6:
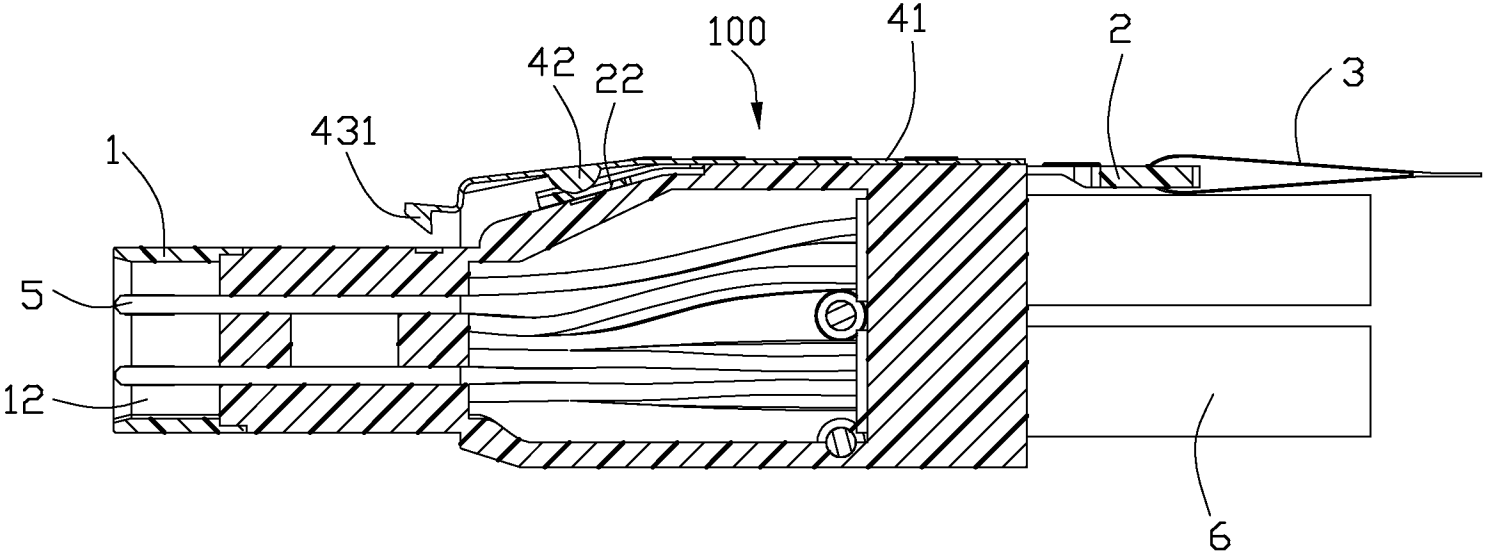
FIG. 6 is a cross-sectional view of the plug connector assembly in an released position, taken along line 5-5 of FIG. 1.

In conjunction with FIG. 6, when the user pulls the pulling tape 3 horizontally to drive the actuator 2 slide, the groove 22 of the actuator 2 in the channel 14 is moved rearwardly. When the groove 22 is arrived at a certain position, the ear portion 42 is risen and climbed out of the groove 22 to drive the latching portion 431 rise from a latched position toward a released position.

In this embodiment, the grooves 22 are defined on the actuator 2, and the ear portions 42 are defined on the latching member 4. In other embodiments, the grooves are also defined on the latching member 4, and the ear portions 42 are defined on the actuator 2. In this embodiment, the place where both the grooves 22 and the ear portions 42 coordinating with each other is located on the ramp 16. In other embodiments, the place where both the grooves 22 and the ear portions 42 coordinating with each other can be located on the supporting portion 13 of the housing 1.

In the prevent invention, the releasing action is needless with the ramp 16 of the housing 1, and only need that the groove 22 of the actuator 2 and the ear portion 42 coordinate with each other. So, the releasing operation is convenient and steady.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. A plug connector comprising:

a housing having a front inserting portion and a rear supporting portion higher than the inserting portion, the rear supporting portion defining a channel and a protruding portion disposed in the channel; and a releasing mechanism mounted on the housing and comprising a pulling portion and a latching member on an upper side of the pulling portion, the latching member defining a latching portion for latching a complementary connector, the pulling portion having two grooves located at two lateral sides of a front end of the pulling portion, respectively, a slot receiving the protruding portion, and an elastic portion located in the slot for resiliently bearing against the protruding portion, the latching member having an extending portion and two ear portions extending downwardly from two lateral sides of the extending portion and engaged with the two grooves, respectively, the ear portion being able to rise out of the groove in response to a rearward movement of the pulling portion to move the latching portion from a latched position to a released position.

2. The plug connector as recited in claim 1, wherein a lower surface of the ear portion is substantially semi-circular.

3. The plug connector as recited in claim 1, wherein the supporting portion defines a pair of ribs and the channel is located between the ribs, the ribs support the latching member, and the pulling portion is engaged in the channel.

4. The plug connector as recited in claim 3, wherein the latching member comprises a covering portion connected to the extending portion and supported by the ribs.

5. The plug connector as recited in claim 4, wherein a pair of retaining portions are defined at two lateral sides of the covering portion, respectively.

6. The plug connector as recited in claim 5, wherein one of the retaining portion and the housing defines a retaining hole, and the other of the retaining portion and the housing defines a snapping portion engaged with the retaining hole.

7. The plug connector as recited in claim 1, wherein the elastic portion is curving rearwardly.

8. The plug connector as recited in claim 7, wherein the pulling portion comprises an actuator slidable in the channel, and a pulling tape engaged with the actuator.

9. A plug connector comprising:

a housing including a front inserting portion defining a receiving cavity therein, a rear horizontal channel and a middle ramp located between the front inserting portion and the rear horizontal channel along a front-to-back direction wherein the front inserting portion defining a horizontal exterior surface which is lower than the horizontal channel in a vertical direction perpendicular to said front-to-back direction, said middle ramp extending in an oblique direction angled to both the front inserting portion and the rear horizontal channel; and a releasing mechanism mounted to the housing and including a latching member and a pulling portion wherein the latching member defines a latching portion at a front end, and the puling portion is sandwiched between the latching member and the housing in the vertical direction with and back and forth movable along the front-to-back direction; wherein a section of the latching member, which is located above the middle ramp, defines at least one downwardly extending ear to be received in a corresponding groove formed in a corresponding area of the pulling portion below said section of the latching member whereby when the pulling portion is moved rearwardly, the latching member is upwardly deflected due to sliding engagement between the ear and a corresponding edge of the groove.

10. The plug connector as claimed in claim 9, wherein said ear defines an arc confronting the corresponding edge of the groove.

11. A plug connector comprising:

a housing including a front inserting portion defining a receiving cavity therein, a rear horizontal channel and a middle ramp located between the front inserting portion and the rear horizontal channel along a front-to-back direction wherein the front inserting portion defining a horizontal exterior surface which is lower than the horizontal channel in a vertical direction perpendicular to said front-to-back direction, said middle ramp extending in an oblique direction angled to both the front inserting portion and the rear horizontal channel; and a releasing mechanism mounted to the housing and including a latching member and a pulling portion wherein the latching member defines a latching portion at a front end, and the puling portion is sandwiched between the latching member and the housing in the vertical direction with and back and forth movable along the front-to-back direction; wherein a section of the latching member, which is located above the middle ramp, defines one of an ear and a groove while an area of the pulling portion sandwiched between said portion of the latching member and the ramp defines the other of said one of the ear and the groove to be engaged with said one of the ear and the groove, whereby when the pulling portion is moved rearwardly, the latching member is upwardly deflected due to sliding engagement between the ear and a corresponding edge of the groove.

12. The plug connector as claimed in claim 10, wherein said ear defines an arc confronting the corresponding edge of the groove.

* * * * *